US006714229B2

(12) United States Patent
Miyazaki et al.

(10) Patent No.: US 6,714,229 B2
(45) Date of Patent: Mar. 30, 2004

(54) IMAGE FORMING APPARATUS

(75) Inventors: Takao Miyazaki, Saitama (JP); Takashi Kawashima, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/436,247

(22) Filed: May 13, 2003

(65) Prior Publication Data

US 2003/0214566 A1 Nov. 20, 2003

(30) Foreign Application Priority Data

May 14, 2002 (JP) ..... 2002-139194

(51) Int. Cl.[7] ..... B41J 29/377; G03G 21/00; B01D 46/00; B01D 46/10; B01D 46/52

(52) U.S. Cl. ..... 347/223; 399/92; 399/93

(58) Field of Search ..... 347/223, 175, 347/212; 399/92, 93

(56) References Cited

U.S. PATENT DOCUMENTS 5,946,078 A * 8/1999 Morimoto et al. ..... 355/30

FOREIGN PATENT DOCUMENTS

| | | | | |
|---|---|---|---|---|
| JP | 06-059549 A | | 3/1994 | |
| JP | 08-220952 A | | 8/1996 | |
| JP | 10307517 | * | 11/1998 | ..... G03G/21/00 |
| JP | 2000-305439 A | | 11/2000 | |
| JP | 2002-023571 A | | 1/2002 | |
| JP | 2002321426 | * | 11/2002 | ..... B41J/29/377 |

* cited by examiner

*Primary Examiner*—Huan Tran
(74) *Attorney, Agent, or Firm*—Sughrue Mion, PLLC

(57) ABSTRACT

A duct is installed in an apparatus housing. The duct has an outside inlet, a first discharge opening, a second discharge opening, and an air filter. Outside air is taken into the duct from the outside inlet through the air filter. The air filter filters the outside air to prevent dust from getting into the duct. A cooling axial flow fan disposed in the vicinity of each of the first and second discharge openings. The cooling axial flow fans blow the filtered outside air into fixing devices to be cooled. Gaps are formed between the cooling axial flow fan and the first discharge opening, and between the other cooling axial flow fan and the second discharge opening, as inside inlets. When the air filter clogs, air in the housing is supplied to the cooling axial flow fans through the gaps, to circulate the air inside the housing.

11 Claims, 5 Drawing Sheets

IMAGE FORMING APPARATUS

BACKGROUND OF THE INVENTION

1. Field of the Invention

The present invention relates to an image forming apparatus which takes outside air into a housing to cool down the inside thereof.

2. Background Arts

In an image forming apparatus such as a printer, a copy machine, a facsimile and the like, there are provided many parts in a housing some of which generate heat. In a color thermal printer in which a thermal head makes tightly contact with a color thermo-sensitive recording paper for thermal recording, for example, a greatest amount of heat is generated from an optical fixing lamp. The fixing lamp fixes the thermal coloring layer of the color thermo-sensitive recording paper. When the bulb temperature of the fixing lamp increases too much, the efficiency of fixing decreases due to decrease in an amount of light emitted therefrom. In the thermal head, a heat element generates heat to form pixels on the thermo-sensitive recording paper, so that the recording density of the color pixels is varied as the temperature of the thermal head increases. Therefore, it is necessary to control the temperature inside the housing of the color thermal printer.

There is known an image forming apparatus which can efficiently cool down the inside of the housing. The image forming apparatus has a duct for discharging the heat inside of the housing into the outside, and a fan for generating airflow inside the duct. Japanese Patent Laid-Open Publication No. 2000-305439, for example, discloses an image forming apparatus having plural discharge fans installed inside a duct in series. A louver of the duct is connected to the inside and outside of a housing. The discharge fans discharge heat generated inside the housing with outside air from a discharge opening connected to the outside of the housing. An image forming apparatus, disclosed by Japanese Patent Laid-Open Publication No. 08-220952, further blows the outside air sucked from the outside of the housing on a heat source to cool it down.

In an image forming apparatus with plural heat sources, as described in Japanese Patent Laid-Open Publications No. 06-059549 and 2002-023571, a duct is so disposed inside the housing as to pass the vicinity of each heat source. An opening is formed in the duct at a position so as to face each heat source. A discharge fan installed inside the duct discharges heat generated from the heat sources into the outside of the housing.

In the above image forming apparatuses, however, dust in the outside air is sucked thereinto with the outside air. The dust tends to cause smudges on a recording paper, so that a print image is adversely affected. For this reason, the image forming apparatuses according to Japanese Patent Laid-Open publications No. 08-220952 and 2002-023571 further comprise an air filter provided inside the duct to eliminate the dust. In these image forming apparatuses, it is possible to prevent degradation in the print image, because the dust in the outside air does not get into the apparatus.

When the air filter disposed inside the duct is clogged with the dust, however, an amount of airflow rapidly decreases. Cooling effect inside the housing extremely becomes worse. Thus, the air filter needs troublesome maintenance, in other words, needs to be exchanged at regular intervals.

In the image forming apparatus according to Japanese Patent Laid-Open publication No. 2002-023571, a switch valve is provided in some of plural discharge openings disposed in a discharge path. Since the switch valve opens and closes in accordance with the clogging of the air filter, it is possible to prevent decrease in the amount of the airflow for discharging. In this image forming apparatus, air filtered by the air filter passes through the discharge openings. Accordingly, in a case where the air filter heavily clogs, the airflow cannot be generated in the discharge path even if the switch valve is opened.

SUMMARY OF THE INVENTION

An object of the present invention is to provide an image forming apparatus which can cool the inside of a housing even when an air filter clogs.

To achieve the above object, an image forming apparatus with a housing according to the present invention comprises a duct provided in the housing, an air filter, an inside inlet, and a cooling fan. The duct has at least one outside inlet opened to the outside of the housing, and at least one discharge opening provided in the housing. The air filter is disposed between the outside inlet and the discharge opening. The inside louver sucks inside air in the housing. The cooling fan is disposed in front of the discharge opening of the housing. The air filter filters outside air sucked into the duct, to prevent dust from getting into the housing. The cooling fan releases mixed air, which includes the outside air entered from the outside inlet and passing through the duct, and the inside air entered from the inside inlet, into the housing, for the purpose of circulating the air inside the housing.

The inside inlet may be a gap formed between the discharge opening and a cooling fan, or may be at least one opening formed in a sidewall of the duct. The opening is formed between the air filter and the cooling fan.

The cooling fan blows the mixed air on a part generating heat to cool it.

A suction fan may be provided in the vicinity of the outside inlet. The suction fan forcefully takes the outside air into the duct through the outside inlet.

The suction fan may be disposed between the outside inlet and the air filter.

The operation of the cooling fan and the suction fan is so controlled by a common controller that the cooling fan and the suction fan rotate in the same timing.

According to the present invention, the air circulates inside a housing even when an air filter clogs, because the image forming apparatus is provided with an inside inlet for sucking inside air in the housing. The air is blown on a part generating heat in the housing, so that it is possible to cool the inside of a housing even when an air filter clogs. It is also possible to contribute to reduction in cost of the image forming apparatus, as the number of the controllers decrease.

BRIEF DESCRIPTION OF THE DRAWINGS

The above objects and advantages of the present invention will become apparent from the following detailed descriptions of the preferred embodiments when read in association with the accompanying drawings, which are given by way of illustration only and thus do not limit the present invention. In the drawings, the same reference numerals designate like or corresponding parts throughout the several views, and wherein.

DETAILED DESCRIPTION OF THE EMBODIMENTS

Figure 1:
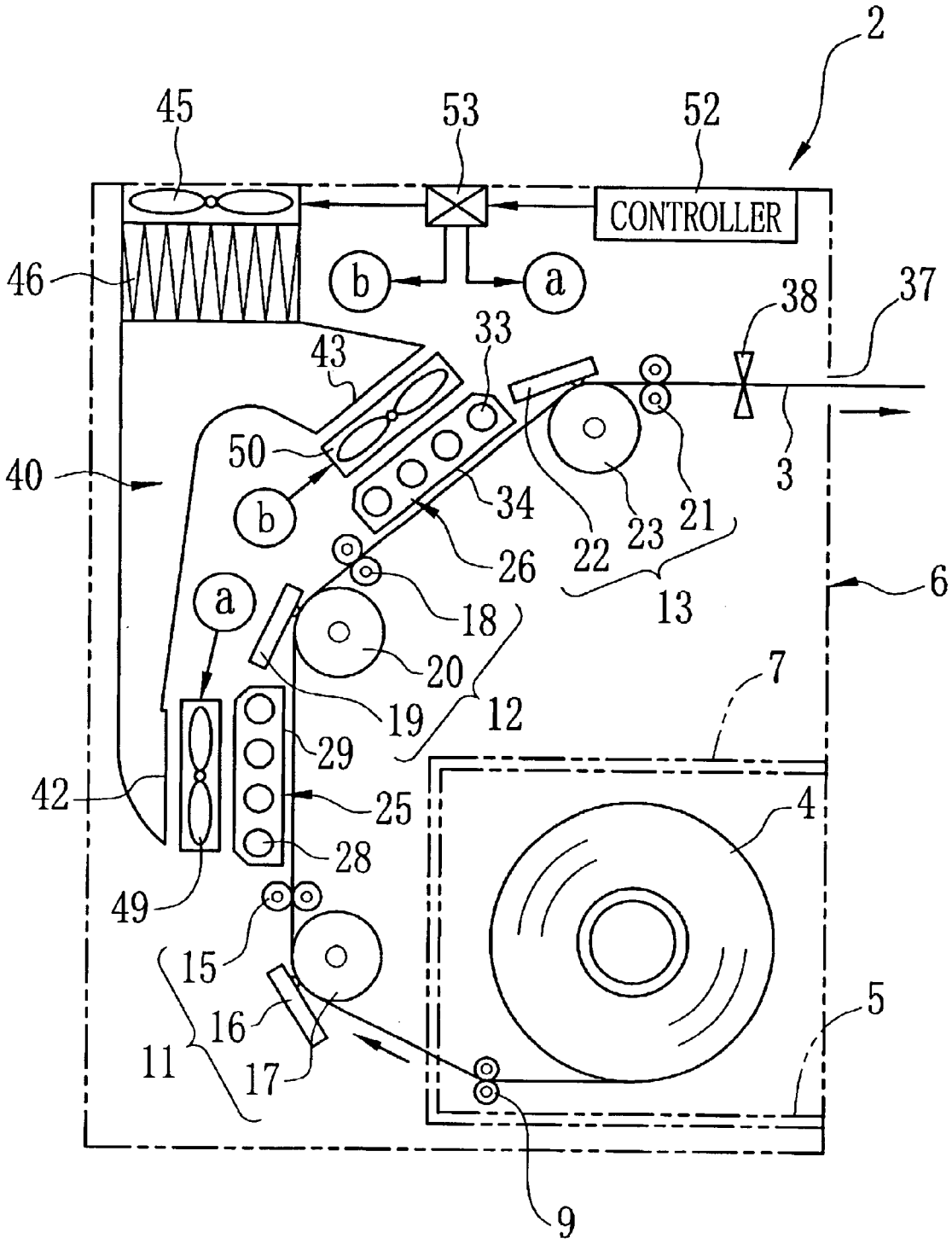
FIG. 1 is a schematic view showing the structure of a color thermal printer.

Referring to FIG. 1, a color thermal printer 2 uses a recording paper roll 4 wound with continuous color thermo-sensitive recording paper 3 as a recording medium. A paper magazine 5 having lightproof construction contains the recording paper roll 4. The paper magazine 5 is set in a paper feed section 7, which is provided in the front surface of a housing 6 of the color thermal printer 2.

A feed roller unit 9 for advancing and retracting the color thermo-sensitive recording paper 3 is attached inside the paper magazine 5. A capstan roller and a pinch roller constitute the feed roller unit 9. Upon setting the paper magazine 5 in the paper feed section 7, the capstan roller is electrically or mechanically connected to the color thermal printer 2, and the operation of the capstan roller is controlled by the printer 2. The color thermo-sensitive recording paper 3 drawn from the paper magazine 5 is carried along an approximately U-shaped carrying path provided inside the housing 6.

The color thermo-sensitive recording paper 3, as is well known, has a cyan thermo-sensitive coloring layer, a magenta thermo-sensitive coloring layer, and a yellow thermo-sensitive coloring layer formed on a base in this order from underneath. Since the yellow thermo-sensitive coloring layer, being a top layer, has the highest heat sensitivity, the yellow thermo-sensitive coloring layer develops a color of yellow with low heat energy. Since the cyan thermo-sensitive coloring layer, being a bottom layer, has the lowest heat sensitivity, the cyan thermo-sensitive coloring layer develops a color of cyan with high heat energy. The yellow thermo-sensitive coloring layer loses its color developing capability when near-ultraviolet rays of 420 nm are irradiated thereto. The magenta thermo-sensitive coloring layer develops a color of magenta with intermediate heat energy between the yellow thermo-sensitive coloring layer and the cyan thermo-sensitive coloring layer, and loses its color developing capability when ultraviolet rays of 365 nm are irradiated thereto.

On the carrying path of the color thermo-sensitive recording paper 3, a yellow printing station 11, a magenta printing station 12, and a cyan printing station 13 are disposed at predetermined intervals. The yellow printing station 11 includes a carry roller set 15, a thermal head 16, and a platen roller 17. The carry roller set 15 carries the color thermo-sensitive recording paper 3 in a paper advancing direction. The thermal head 16 is pressed to contact with the color thermo-sensitive recording paper 3 to develop the yellow thermo-sensitive coloring layer. The platen roller 17 rotates in accordance with the carry of the color thermo-sensitive recording paper 3, with nipping the color thermo-sensitive recording paper 3 with the thermal head 16.

The carry roller set 15 comprises a capstan roller rotated by a stepping motor, and a pinch roller nipping the color thermo-sensitive recording paper 3 with the capstan roller.

The thermal head 16 is provided with a heating element array in which a lot of heating elements are linearly arranged. In printing, the heating element array is pressed to contact with the color thermo-sensitive recording paper 3 on the platen roller 17. When the heating element array generates heat, the heat energy therefrom develops the yellow thermo-sensitive coloring layer of the color thermo-sensitive recording paper 3.

The magenta printing station 12 and the cyan printing station 13 are provided with carry roller sets 18 and 21, thermal heads 19 and 22, and platen rollers 20 and 23, respectively. The structure of the magenta printing station 12 and the cyan printing station 13 is the same as that of the yellow printing station 11, so detailed description is omitted.

A yellow fixing device 25 is disposed between the yellow printing station 11 and the magenta printing station 12. A magenta fixing device 26 is disposed between the magenta printing station 12 and the cyan printing station 13. The yellow fixing device 25, which fixes the yellow thermo-sensitive coloring layer of the color thermo-sensitive recording paper 3, comprises plural ultraviolet lamps 28 for radiating the near-ultraviolet rays the emission peak of which is 420 nm, and an approximately box-shaped lamp house 29 for containing the ultraviolet lamps 28. The ultraviolet lamp 28 is in the shape of a bar extending to the widthwise direction of the color thermo-sensitive recording paper 2.

Figure 2:
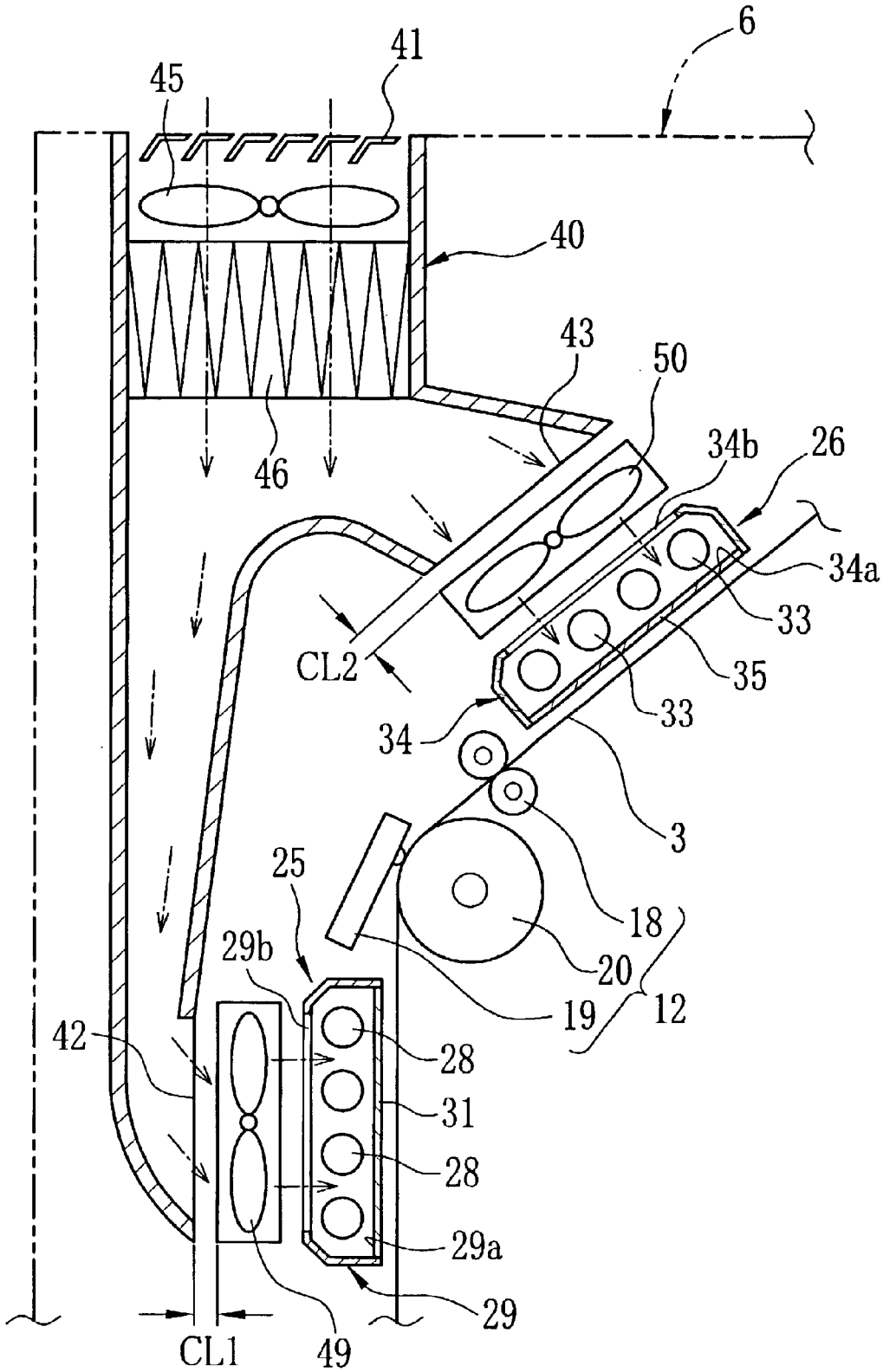
FIG. 2 is an explanatory view showing airflow during printing.

Referring to FIG. 2, the lamp house 29 is provided with an irradiation opening 29*a* which is formed in the surface opposite to the color thermo-sensitive recording paper 3. The ultraviolet lamps 28 irradiate the color thermo-sensitive recording paper 3 with the ultraviolet rays through the irradiation opening 29*a*. A transparent guide plate 31 is fitted into the irradiation opening 29*a*. The guide plate 31, made out of transparent materials such as glass and acrylic, allows the ultraviolet rays to pass through. A cooling opening 29*b*, into which airflow for cooling flows, is formed in the surface opposite to the irradiation opening 29*a*, of the lamp house 29.

The magenta fixing device 26 is provided with a lamp house 34 and a guide plate 35. The lamp house 34 has ultraviolet lamps 33 for radiating the ultraviolet rays the emission peak of which is 365 nm, an irradiation opening 34*a*, and a cooling opening 34*b*. The structure of the lamp house 34 and the guide plate 35 is the same as that of the yellow fixing device 25, so detailed description is omitted.

An ejection slit 37 as the lowest reaches of the carrying path is provided in the upper portion of the front wall of the housing 6. A cutter 38 for cutting the continuous color thermo-sensitive recording paper 3 is provided at inside of the ejection slit 37. The printed color thermo-sensitive recording paper 3 cut by the cutter 38 into a predetermined size is ejected through the ejection slit 37.

On the backward of the color thermal printer 2, a duct 40 is disposed on the top wall of the housing 6 in such a manner as to face downward. The duct 40 has a louver 41 (referring to FIG. 2) as an outside inlet formed in the top wall of the housing 6 to take in outside air, a first discharge opening 42 disposed in the vicinity of the yellow fixing device 25, and a second discharge opening 43 disposed in the vicinity of the magenta fixing device 26.

A suction axial flow fan 45 for taking outside air into the duct 40, and an air filter 46 for filtering the taken outside air are installed inside of the louver 41 in the duct 40. The suction axial flow fan 45 is so disposed near the louver 41 as to efficiently take the outside air into the housing 6. The air filter 46 has a filtering member folded in the shape of pleats. Since the surface area of the filtering member is large, it is possible to use the air filter 46 for the long term without clogging up. The positions of the suction axial flow fan 45 and the air filter 46 may be changed.

A first axial flow fan 49 for cooling is disposed between the first discharge opening 42 and the yellow fixing device 25. A second axial flow fan 50 for cooling is disposed between the second discharge opening 43 and the magenta fixing device 26. The first and second axial flow fans 49 and 50 blow the filtered outside air flowing into the duct 40 into the yellow and magenta fixing devices 25 and 26, respectively.

Figure 3:
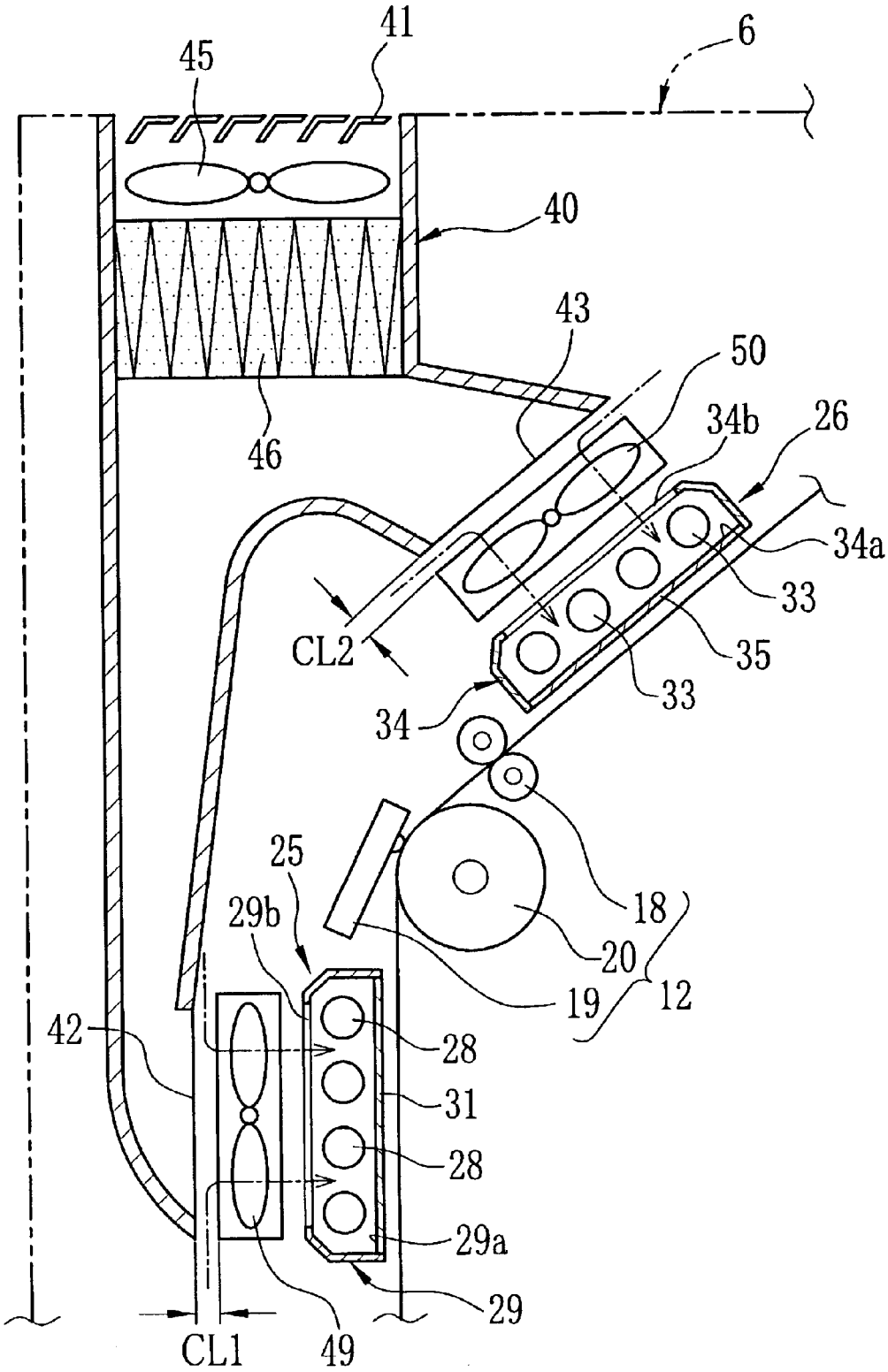
FIG. 3 is an explanatory view showing airflow when an air filter clogs.

The first axial flow fan 49 is disposed in front of the first discharge opening 42 of the duct 40 with keeping a gap CL1 as an inlet for inside air. When the outside air is not sucked through the louver 41 due to the clogging of the air filter 46, or when an amount of sucked air is extremely decreased, as shown in FIG. 3, air is supplied to the first axial flow fan 49 through the gap CL1, in order to circulate the air inside the housing 6. The second axial flow fan 50 is disposed in front of the second discharge opening 43 with keeping a gap CL2 having the same function as the gap CL1. The size of the gap between the discharge openings and the axial flow fan is determined with considering the static pressure of the axial flow fan. Accordingly, steep increase in temperature of the installed parts is prevented, because the air circulates inside the housing 6 even when the air filter clogs up. It is possible to prevent degradation in the image quality of a print due to insufficient fixing, and increase in time of the print.

According to the present invention, the air is circulated inside the housing 6 by the first and second axial flow fans 49 and 50 for cooling, even when the air filter 46 clogs up. Thus, it is unnecessary to separately control the suction axial flow fan 45 and the first and second axial flow fans 49 and 50, on the contrary, they may be controlled in the same timing. In this case, a common controller 52 and driver 53 can control the rotation of the suction axial flow fan 45 and the first and second axial flow fans 49 and 50, so that it is possible to contribute to cost reduction.

The operation of the above color thermal printer 2 will be hereinafter described. Upon starting the print, the controller 52 rotates the suction axial flow fan 45 and the first and second axial flow fans 49 and 50 via the driver 53. Each of the axial flow fans 45, 49 and 50 may start rotating at the same time as the power-on of the color thermal printer 2, or may start rotating when the measured temperature of the yellow fixing device 25 and the magenta fixing device 26 exceeds a predetermined value.

Referring to FIG. 2, the suction axial flow fan 45 takes the air outside of the housing 6 into the duct 40 through the louver 41. The outside air flowing into the duct 40 is filtered by the air filter 46 to eliminate a foreign object like dust. The filtered outside air flowing through the duct 40 is released from the first and second discharge openings 42 and 43 by the static pressure of the first and second axial flow fans 49 and 50.

The first axial flow fan 49 blows the outside air released from the first discharge opening 42 into the lamp house 29 through the cooling opening 29*b* of the yellow fixing device 25, for the purpose of cooling the ultraviolet lamps 28. The second axial flow fan 50 blows the outside air released from the second discharge opening 43 into the lamp house 34 through the cooling opening 34*b* of the magenta fixing device 26, for the purpose of cooling the ultraviolet lamps 33.

The feed roller unit 9 carries the color thermo-sensitive recording paper 3, drawn out from the recording paper roll 4, along the carrying path of the color thermal printer 2. In the yellow printing station 11, the carry roller set 15 carries the color thermo-sensitive recording paper 3 at a constant speed in the paper advancing direction. While doing so, the thermal head 16 nips the color thermo-sensitive recording paper 3 with the platen roller 17, to print the yellow image on the yellow thermo-sensitive coloring layer.

In order to fix the yellow thermo-sensitive coloring layer, the yellow fixing device 25 irradiates the color thermo-sensitive recording paper 3, on which the yellow image is printed, with the near-ultraviolet rays having the emission peak of 420 nm. An amount of light emitted from the ultraviolet lamps 28 does not decrease, because the first axial flow fan 49 cools the yellow fixing device 25.

The color thermo-sensitive recording paper 3 with the fixed yellow thermo-sensitive coloring layer is sent to the magenta printing station 12. In the magenta printing station 12, the thermal head 19 prints the magenta image on the magenta thermo-sensitive coloring layer, while the carry roller set 18 carries the color thermo-sensitive recording paper 3 at a constant speed in the paper advancing direction.

In order to fix the magenta thermo-sensitive coloring layer, the magenta fixing device 26 irradiates the color thermo-sensitive recording paper 3, on which the magenta image is printed, with the ultraviolet rays having the emission peak of 365 nm. An amount of light emitted from the ultraviolet lamps 34 does not decrease, because the second axial flow fan 50 cools the magenta fixing device 26.

Then, the color thermo-sensitive recording paper 3 is sent to the cyan printing section 13. The thermal head 22 prints the cyan image on the cyan thermo-sensitive coloring layer. The color thermo-sensitive recording paper 3 on which three primary color images are printed is cut by the cutter 38, and is ejected from the ejection slit 37 out of the housing 6.

Figure 4:
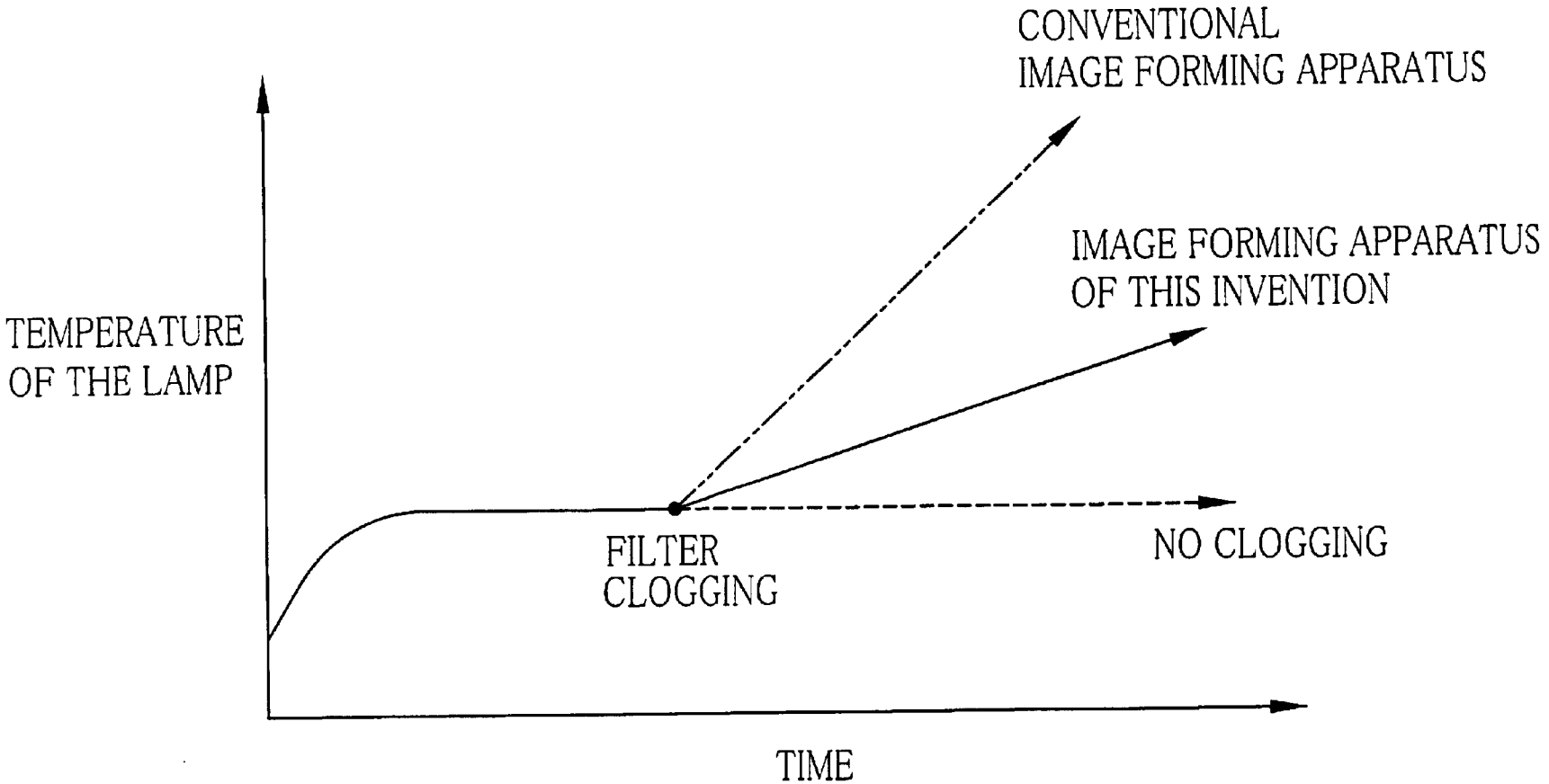
FIG. 4 is a graph showing variation in temperature of an ultraviolet lamp when the air filter clogs.

When the printing operation as described above is carried out for the long terms, the air filter 46 comes to be clogged up with the dust in the outside air. In a conventional color thermal printer which takes in air only from an air filter, an amount of air supplied from a suction axial flow fan decreases when the air filter clogs. Accordingly, as shown in FIG. 4, the bulb temperature of ultraviolet lamps suddenly increases after the clogging of the air filter. Decrease in an amount of light emitted from the ultraviolet lamps, due to increase in the bulb temperature thereof, causes defect in fixing an image and delay in fixing time.

In the present invention, however, the gaps CL1 and CL2 are provided between the first discharge opening 42 and the first axial flow fan 49, and between the second discharge opening 43 and the second axial flow fan 50, respectively. When suction resistance increases due to the clogging of the air filter 46, as shown in FIG. 3, the air inside of the housing 6 is supplied to the first and the second axial flow fans 49 and 50 through the gaps CL1 and CL2. Accordingly, as shown in FIG. 4, the temperature of the yellow fixing device 25 and the magenta fixing device 26 is prevented from increasing.

The gaps CL1 and CL2 as the inlets are provided in the vicinity of the first and second axial flow fans 49 and 50. Therefore, it is possible to efficiently use the air blow power of the first and second axial flow fans 49 and 50. The yellow fixing device 25 and the magenta fixing device 26 are so disposed in the lower reaches of airflow by the first and second axial flow fans 49 and 50, as to be cooled down effectively. If the clogged air filter 46 is exchanged with a new one, as shown with a broken line of FIG. 4, the bulb temperature of the ultraviolet lamps is lowered to an appropriate value.

Figure 5:
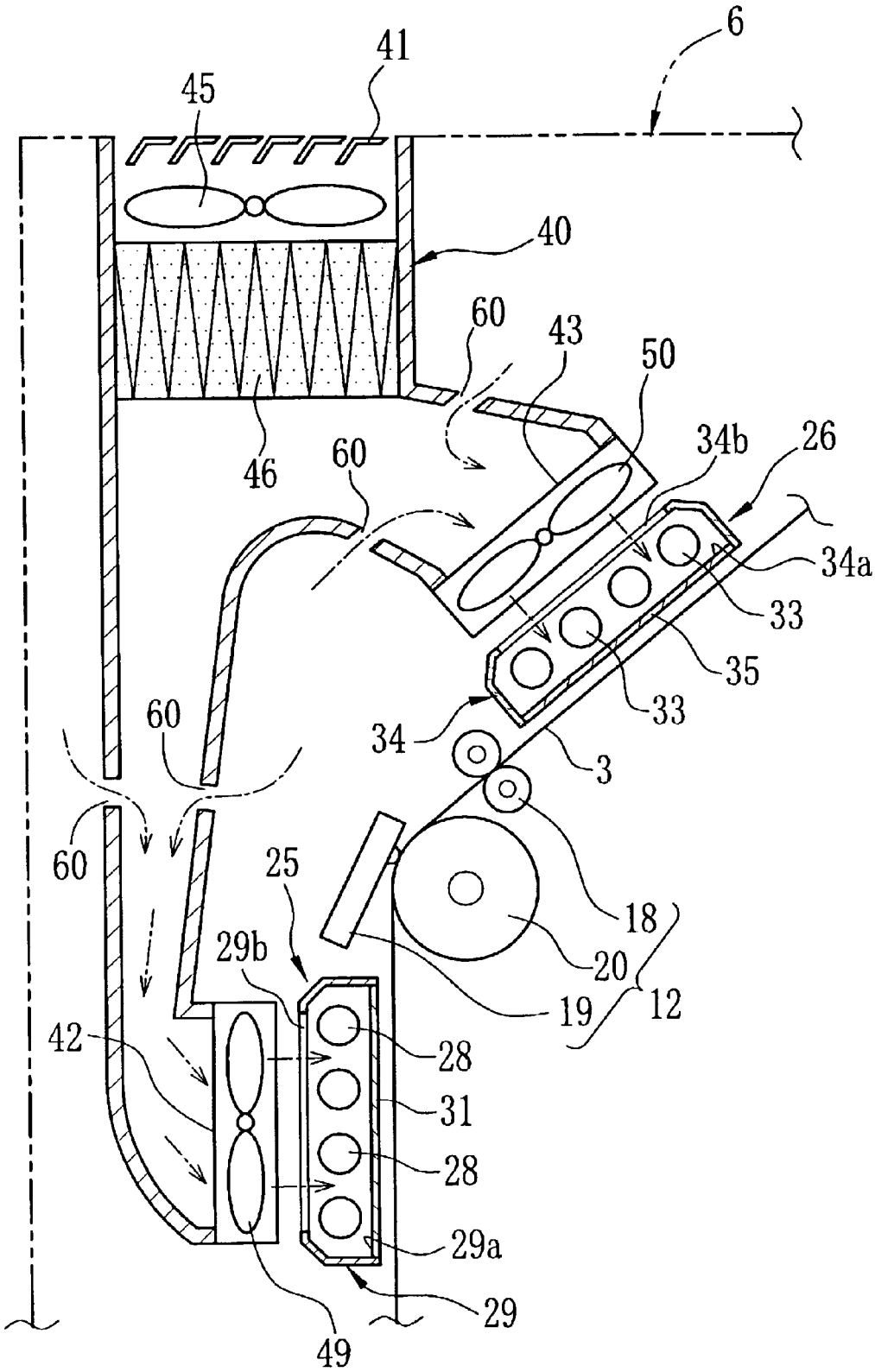
FIG. 5 is an explanatory view showing airflow in a color thermal printer according to another embodiment, when an air filter clogs.

In the above embodiment, the gaps CL1 and CL2 are provided as the inlets. However, as shown in FIG. 5, plural openings 60 may be formed in the wall of the duct 40 as the inlets. The openings 60 are formed between the air filter 46 and the first discharge opening 42, and between the air filter 46 and the second discharge opening 43. Since the air at various locations inside of the housing 6 is sucked into the duct 40, it is possible to further improve the circulatory efficiency of the air inside of the housing 6. Both the gaps CL1 and CL2 and the openings 60 may be provided as the inlets.

The above embodiment uses the color thermo-sensitive recording paper 3 with triple layer structure having the cyan, magenta, and yellow thermo-sensitive coloring layers. However, for example, a color thermo-sensitive recording paper with quadruple layer structure may be used. The color thermo-sensitive recording paper with the quadruple layer has a black thermo-sensitive coloring layer in addition to the three coloring layers described above.

The suction axial flow fan 45 and the first and second axial flow fans 49 and 50, which rotate in the same timing in the above embodiment, may rotate independently. In this case, the rotation of the suction axial flow fan 45 may stop in response to the clogging, detected by an airflow sensor provided inside the duct 40.

The axial flow fans are used in the above embodiment, but a sirocco fan, a cross flow fan, or the like may be used.

In the above embodiment, the color thermal printer is three-head one-path type. The present invention, however, maybe applied to a one-head three-path type of color thermal printer, which prints color images with reciprocating the recording paper.

In the above embodiment, the present invention is applied to the color thermal printer. The present invention, however, may be applied to a dye sublimation type printer and a wax-transfer type printer with color ink sheets of yellow, magenta, and cyan, a printer with a toner cartridge, an image forming apparatus such as a copying machine, a facsimile and the like, a machine containing a part which generates heat.

Although the present invention has been described with respect to the preferred embodiment, the preset invention is not to be limited to the above embodiment but, on the contrary, various modifications will be possible to those skilled in the art without departing from the scope of claims appended hereto.

What is claimed is:

1. An image forming apparatus having a housing comprising:

a duct provided in said housing, said duct having at least one outside inlet opened to the outside of said housing, and at least one discharge opening provided in said housing;

an air filter disposed between said outside inlet and said discharge opening, said air filter filtering outside air sucked into said duct through said outside inlet to eliminate dust from the outside air;

an inside inlet for sucking inside air into said housing; and a cooling fan disposed in front of said discharge opening of said housing, said cooling fan releasing mixed air into the inside of said housing, said mixed air including the outside air entered from said outside inlet and passing through said duct and the inside air entered from said inside inlet.

2. An image forming apparatus as recited in claim 1, wherein said inside inlet is a gap formed between said discharge opening and said cooling fan.

3. An image forming apparatus as recited in claim 1, wherein said inside inlet is at least one opening formed in a wall of said duct, and said opening is formed between said air filter and said cooling fan.

4. An image forming apparatus as recited in claim 1, wherein said cooling fan blows said mixed air on a part generating heat.

5. An image forming apparatus as recited in claim 1, further comprising:

a suction fan disposed in the vicinity of said outside inlet, said suction fan forcefully taking the outside air into said duct through said outside inlet.

6. An image forming apparatus as recited in claim 5, wherein said suction fan is disposed between said outside inlet and said air filter.

7. An image forming apparatus as recited in claim 5, further comprising:

a controller for controlling said cooling fan and said suction fan, said controller starting and stopping rotation of said cooling fan and said suction fan in the same timing.

8. A thermal printer having a fixing device which fixes an image recorded on a thermo-sensitive recording paper by electromagnetic rays radiated in a housing, said thermal printer comprising:

a duct provided in said housing, said duct having at least one outside inlet and at least one discharge opening, said outside inlet being connected to the outside of said housing;

an air filter disposed between said outside inlet and said discharge opening, said air filter eliminating dust from outside air sucked into said duct through said outside inlet;

a cooling fan disposed in front of said discharge opening, said cooling fan blowing the air passing through said duct on said fixing device; and an inside inlet for supplying the air in said housing to said cooling fan.

9. A printer as recited in claim 8, wherein said inside inlet is a gap formed between said discharge opening and said cooling fan.

10. A printer as recited in claim 8, wherein said inside inlet is at least one opening formed in a sidewall of said duct, and said opening is positioned between said air filter and said cooling fan.

11. A printer as recited in claim 8, further comprising:

a suction fan disposed in the vicinity of said outside inlet, said suction fan blowing the outside air into said duct through said outside inlet.

* * * * *